US009055373B2

(12) United States Patent
Kijima et al.

(10) Patent No.: US 9,055,373 B2
(45) Date of Patent: Jun. 9, 2015

(54) PIEZOELECTRIC SOUNDER

(71) Applicant: TDK CORPORATION, Tokyo (JP)

(72) Inventors: Kaoru Kijima, Tokyo (JP); Akira Satoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/031,724

(22) Filed: Sep. 19, 2013

(65) Prior Publication Data

US 2014/0086436 A1 Mar. 27, 2014

(30) Foreign Application Priority Data

Sep. 25, 2012 (JP) ..... 2012-211202

(51) Int. Cl.

*H04R 17/10* (2006.01)
*H04R 17/00* (2006.01)
*H04R 1/28* (2006.01)

(52) U.S. Cl.

CPC ..... *H04R 17/10* (2013.01); *H04R 17/00* (2013.01); *H04R 2400/00* (2013.01); *H04R 2499/11* (2013.01); *H04R 1/2803* (2013.01)

(58) Field of Classification Search

CPC ..... H04R 17/10; H04R 17/00; H04R 41/00; H04R 17/005; H04R 17/02; H04R 1/02; H04R 1/021; H04R 2201/02; H04R 2217/01; H01L 41/00

USPC ..... 381/190, 150, 338, 345, 346, 173

See application file for complete search history.

(56) References Cited

U.S. PATENT DOCUMENTS

| | | | | |
|---|---|---|---|---|
| 5,524,061 | A * | 6/1996 | Mooney et al. | 381/151 |
| 5,955,824 | A * | 9/1999 | Saito et al. | 310/348 |
| 6,590,992 | B1 * | 7/2003 | Nakamura | 381/430 |
| 7,564,988 | B2 * | 7/2009 | Azima et al. | 381/326 |

FOREIGN PATENT DOCUMENTS

| | | |
|---|---|---|
| JP | A-11-052958 | 2/1999 |
| JP | B2-4295781 | 7/2009 |

* cited by examiner

*Primary Examiner* — Ahmad F Matar
*Assistant Examiner* — Sabrina Diaz
(74) *Attorney, Agent, or Firm* — Oliff PLC

(57) ABSTRACT

A piezoelectric sounder for transmitting a signal by using a sound comprises a piezoelectric diaphragm constructed by attaching a piezoelectric element to a metal sheet, a ease containing the piezoelectric diaphragm and having a resonance space defined therewithin and adapted to resonate as the piezoelectric diaphragm vibrates, a pair of terminals electrically connected to the metal sheet and piezoelectric element of the piezoelectric diaphragm, while the piezoelectric sounder has no resonance points fr, fa in a frequency range of the signal. Thus removing the resonance points fr, fa from the frequency band of the signal to be transmitted prevents the signal transmission distance from shortening at the resonance points, thereby improving the stability in communications.

4 Claims, 4 Drawing Sheets

PIEZOELECTRIC SOUNDER

BACKGROUND OF THE INVENTION

1. Field of the Invention

The present invention relates to a piezoelectric sounder which transmits a signal by using a sound.

2. Related Background Art

There has conventionally been known a communication method (e.g., Patent Literature 1 (Japanese Patent Publication No. 4295781)) which, by utilizing an existing speaker serving as a sounding component and a microphone mounted on a terminal such as a mobile phone, transmits a signal to the terminal through the medium of air.

Applications of the above-mentioned communication method which have recently been under consideration include transmitting program information data from TV speakers and sending data by a distance of only about several meters from small-sized healthcare devices.

However, typical speakers which have been considered for use in the above-mentioned communication method are mainly those of the dynamic type, which are very hard to reduce their size, weight, and power consumption.

Preferred for reducing the size of sounding components is a piezoelectric sounder such as the one disclosed in Patent Literature 2 (Japanese Patent Application Laid-Open No. 11-52958), which is easier to reduce the size, weight, and power consumption than the dynamic speakers. A small-sized piezoelectric sounder can achieve a case size with a diameter of 13 mm or less and a height of 8 mm or less, for example.

In such a piezoelectric sounder, the frequency band of 16 to 20 kHz is suitable for short-distance communications, frequencies lower than 16 kHz make sounds easier to hear and thus are unsuitable for communications, and frequencies higher than 20 kHz slow down the data transmission speed and thus are unsuitable for data communications.

SUMMARY OF THE INVENTION

When the above-mentioned small-sized piezoelectric sounder is employed as a sounding component, however, a part of signals may fail to reach a receiving microphone located at a predetermined distance (short distance) therefrom in the frequency band of 16 to 20 kHz, thus yielding an unstable communication state.

The inventors diligently studied the stability in communications and have found that it is caused in relation to resonance points of the piezoelectric sounder.

For solving the problem mentioned above, it is an object of the present invention to provide a piezoelectric sounder which improves the stability in communications.

The piezoelectric sounder in accordance with the present invention is a piezoelectric device for transmitting a signal by using a sound, the piezoelectric sounder comprising a piezoelectric diaphragm constructed by attaching a piezoelectric element to a metal sheet, a case containing the piezoelectric diaphragm and having a resonance space defined therewithin and adapted to resonate as the piezoelectric diaphragm vibrates, and a pair of terminals electrically connected to the metal sheet and piezoelectric element of the piezoelectric diaphragm; wherein the piezoelectric sounder has no resonance point in a frequency range of the signal.

The inventors have newly found that, when a resonance point of a piezoelectric sounder exists in a frequency band of a signal to be transmitted, the signal transmission distance is remarkably shortened at the resonance point. Hence, by removing the resonance point from the frequency band of the signal to be transmitted, the piezoelectric sounder of the present invention prevents the signal transmission distance from shortening, thereby improving the stability in communications.

A material constituting the case may have a flexural modulus of 6000 MPa or higher. This restrains resonance points from fluctuating among a plurality of piezoelectric sounders and thus can improve the stability in communications among a plurality of piezoelectric sounders having the same design.

The present invention provides a piezoelectric sounder which improves the stability in communications.

DESCRIPTION OF TUE PREFERRED EMBODIMENTS

In the following, preferred embodiments of the present invention will be explained in detail with reference to the accompanying drawings. In the explanation, the same constituents or those having the same functions will be referred to with the same signs while omitting their overlapping descriptions.

The piezoelectric sounder in accordance with the present invention is a device which sends a sound signal through the medium of air and used in short-distance communications on the order of 0.1 to 2 m, for example.

Figure 1:
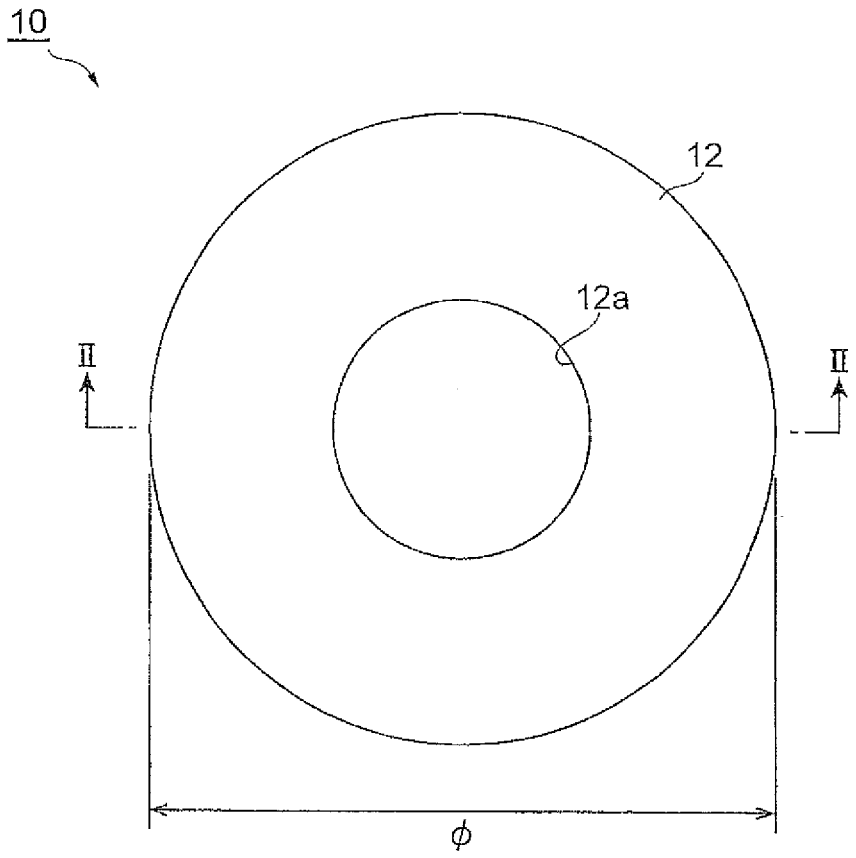
FIG. 1 is a schematic plan view illustrating the piezoelectric sounder in accordance with an embodiment of the present invention.
Figure 2:
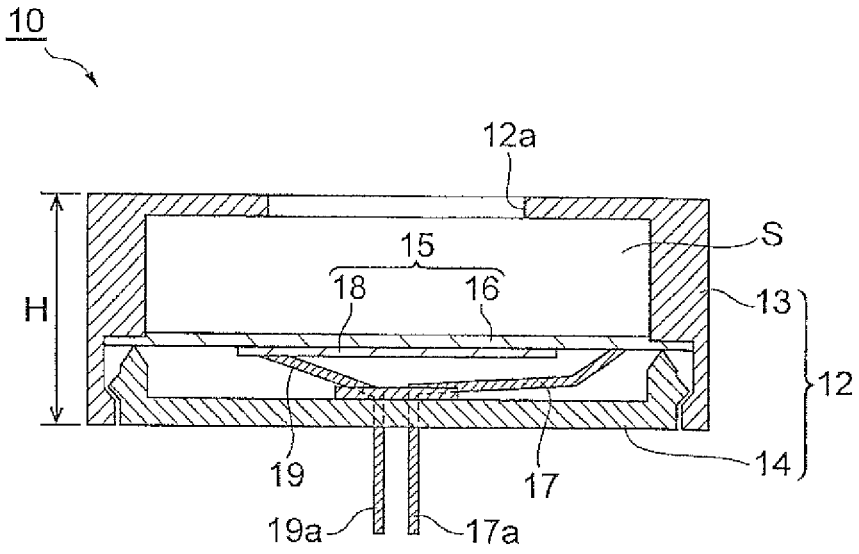
FIG. 2 is a sectional view of the piezoelectric sounder taken along the line II-II of FIG. 1.

As illustrated in FIGS. 1 and 2, this piezoelectric sounder 10 has a structure in which a piezoelectric diaphragm 15 is contained in a case 12.

The piezoelectric diaphragm 15 has a disc form and is constructed such that a piezoelectric element 18 is attached to the lower face of a metal sheet 16 with an adhesive. Employable as the piezoelectric element 18 are piezoelectric ceramics such as those based on lead zirconate titanate, for example.

The case 12 is constructed by an upper case 13 and a lower case 14, which define therebetween a resonance space S which resonates as the piezoelectric diaphragm vibrates. The case size has a diameter (ϕ) of 13 mm or less (e.g., 12 mm) and a height (H) of 8 mm or less (e.g., 3.5 mm). The case has such a small size that the piezoelectric sounder 10 is sufficiently made smaller for practical use.

The upper case 13 is arranged so as to cover the piezoelectric diaphragm 15 from thereabove and has a top plate part provided with an opening 12*a* serving as a sound release hole. The lower case 14 is arranged so as to support the piezoelectric diaphragm 15 from thereunder and upholds an edge of the piezoelectric diaphragm 15 at an annular support part projecting to the piezoelectric diaphragm 15.

Each of the upper and lower cases 13, 14 in the case 12 is constituted by a synthetic resin such as a PBT or ABS resin. Each of materials constituting the upper and lower cases 13, 14 has a high flexural modulus, which is 6000 MPa or higher, preferably 7300 MPa or higher (e.g., 7600 MPa), in a measurement test conforming to ISO 178.

A first terminal 17 is electrically connected to the lower face of the metal sheet 16, a second terminal 19 is connected to the lower face of the piezoelectric element 18, and the pair of terminals 17, 19 are connected to outer electrodes (not depicted) at their respective end parts 17*a*, 19*a* drawn out of the case 12.

Since the piezoelectric sounder 10 is constructed as in the foregoing, when a signal (AC voltage) whose voltage periodically reverses its direction is fed between the pair of terminals 17, 19, the piezoelectric element 18 expands or shrinks in surface directions, so as to vibrate the piezoelectric diaphragm 15, thereby emitting a sound wave.

Resonance points of the above-mentioned piezoelectric sounder 10 will now be explained with reference to FIGS. 3 and 4.

Figure 3:
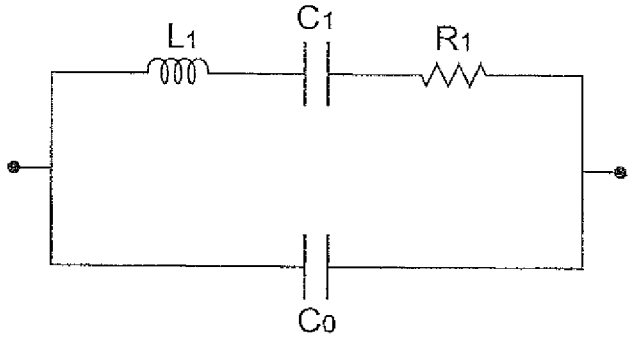
FIG. 3 is a diagram illustrating an equivalent circuit near resonance points of the piezoelectric sounder illustrated in FIGS. 1 and 2.

The resonance points (resonance frequencies (fir) and antiresonance frequencies (fa)) of the piezoelectric sounder 10 can be represented according to an equivalent circuit near the resonance frequencies as illustrated in FIG. 3 as follows:

$$fr=1/\{2\pi\sqrt{L_1C_1}\}$$

$$fa=1/\{2\pi\sqrt{L_1C_0C_1/(C_1+C_0)}\}$$

In FIG. 3 and the above two equations, $L_1$ is the series inductance, $C_1$ is the series capacitance, $C_0$ is the parallel capacitance, and $R_1$ is the series resistance.

For actually determining the resonance frequencies (fr) and antiresonance frequencies (fa) of the piezoelectric sounder 10, an impedance analyzer is connected to the pair of terminals 17, 19 of the piezoelectric sounder 10, the frequency is swept thereby, and the impedance and phase are measured, so as to find out resonance points. As the impedance analyzer, the model 4194 manufactured by Hewlett-Packard Company, for example, may be used.

Figure 4:
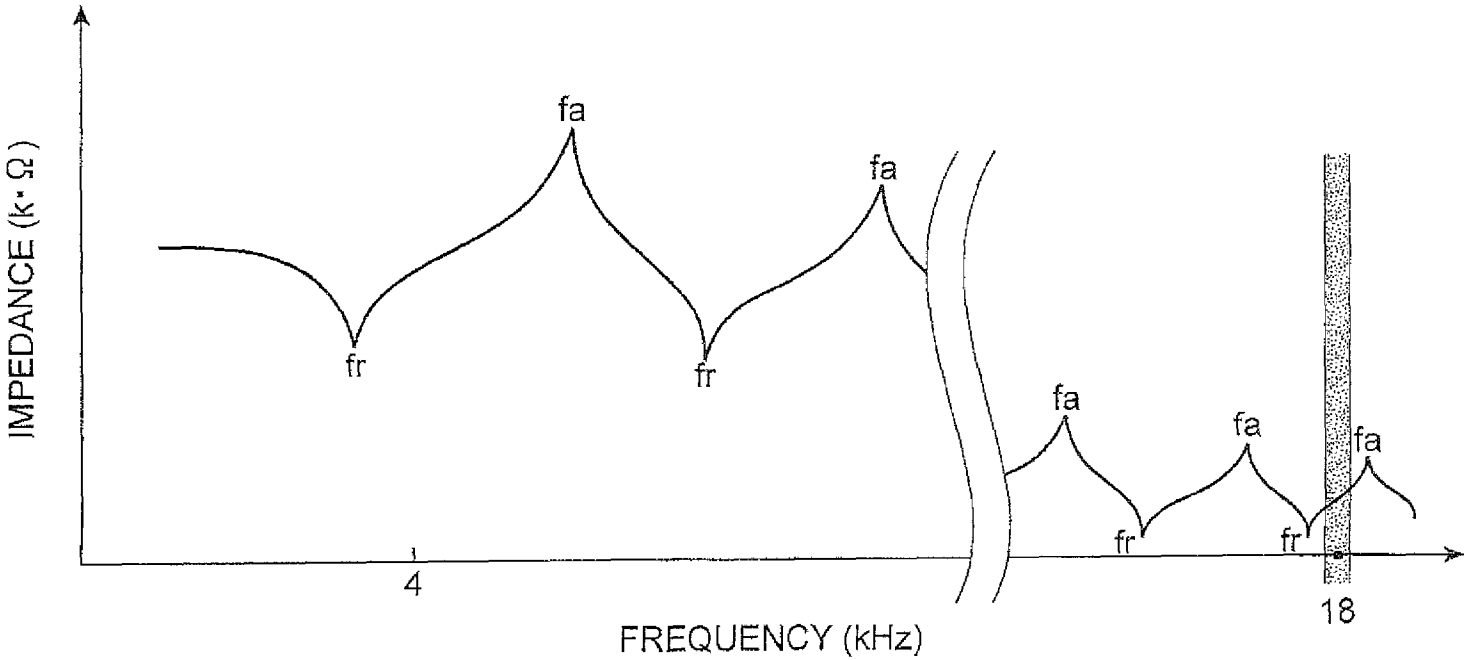
FIG. 4 is a chart illustrating an impedance characteristic of the piezoelectric sounder illustrated in FIGS. 1 and 2.

FIG. 4 is a graph illustrating an impedance characteristic of the piezoelectric sounder 10, indicating the resonance points fr, fa therein. As illustrated in this graph, the piezoelectric sounder 10 has a plurality of resonance points fr, fa resulting from components such as the case 12, piezoelectric diaphragm 15, and pair of terminals 17, 19.

The piezoelectric sounder 10 uses a frequency band near 18 kHz dotted in FIG. 4 (more specifically the band of 16 to 20 kHz) as a frequency range of signals to be transmitted. In the piezoelectric sounder 10, the frequency band of 16 to 20 kHz is suitable for short-distance communications, frequencies lower than 16 kHz make sounds easier to hear and thus are unsuitable for communications, and frequencies higher than 20 kHz slow down the data transmission speed and thus are unsuitable for data communications.

In the piezoelectric sounder 10, none of the resonance points fr, fa exists in the frequency band of 16 to 20 kHz.

Here, the inventors have newly found that, when a resonance point of a piezoelectric sounder exists in a frequency band of a signal to be transmitted, the signal transmission distance is remarkably shortened at the resonance point. This seems to be because of the fact that the energy of the piezoelectric sounder for transmitting sound signals is consumed by the resonance energy of the piezoelectric sounder, whereby its signal transmission distance is shortened.

Therefore, by removing all the resonance points fr, fa of the piezoelectric sounder 10 from a frequency band near 18 kHz which is a frequency band of signals to be transmitted, the inventors have prevented the signal transmission distance from shortening at the resonance points. That is, in the piezoelectric sounder 10, the signal transmission distance is not shortened in the whole frequency band of signals to be transmitted, so that communications can be secured at designed distances, whereby high stability is achieved in communications.

In addition, the flexural modulus of the synthetic resin constituting the case 12 is 6000 MPa or higher in the piezoelectric sounder 10 as mentioned above. When the flexural modulus of the synthetic resin constituting the case 12 is lower than 6000 MPa, resonance points may shift to a frequency band (the band of 16 to 20 kHz) near 18 kHz, thereby reducing the stability in communications. By contrast, the flexural modulus of 6000 MPa or higher effectively inhibits the resonance points from shifting, thereby restraining the resonance points fr, fa from fluctuating among a plurality of piezoelectric sounders 10 being produced. Hence, each of a plurality of piezoelectric sounders 10 having the same design can achieve high stability in communications.

What is claimed is:

1. A piezoelectric sounder for transmitting a signal by using a sound, the piezoelectric sounder comprising:

a piezoelectric diaphragm constructed by attaching a piezoelectric element to a metal sheet;

a case containing the piezoelectric diaphragm and having a resonance space defined therewithin and adapted to resonate as the piezoelectric diaphragm vibrates; and a pair of terminals electrically connected to the metal sheet and piezoelectric element of the piezoelectric diaphragm;

wherein the piezoelectric sounder has a plurality of resonance points including both a resonance point higher than a frequency range of the signal and a resonance point lower than the frequency range of the signal, and does not have any resonance points in the frequency range of the signal, the frequency range of the signal being 16 to 20 kHz.

2. A piezoelectric sounder according to claim 1, wherein a material constituting the case has a flexural modulus of 6000 MPa or higher.

3. A piezoelectric sounder according to claim 1, wherein the piezoelectric sounder has no resonance point including resonance frequencies (fr) and antiresonance frequencies (fa) in the frequency range of the signal.

4. A piezoelectric sounder according to claim 1, wherein the piezoelectric sounder has no resonance point in the frequency range of the signal, and wherein the frequency range of the signal exists between resonance frequencies (fr) and antiresonance frequencies (fa).

* * * * *